US010276334B2

(12) United States Patent
Meier et al.

(10) Patent No.: US 10,276,334 B2
(45) Date of Patent: Apr. 30, 2019

(54) LINER ARRANGEMENT AND A CIRCUIT BREAKER WITH A LINER ARRANGEMENT AND METHOD FOR PROTECTING AN INSULATOR BODY

(71) Applicant: ABB Schweiz AG, Baden (CH)

(72) Inventors: Guido Meier, Würenlingen (CH); Jean-Claude Mauroux, Hunzenschwil (CH)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/797,433

(22) Filed: Oct. 30, 2017

(65) Prior Publication Data

US 2018/0122602 A1 May 3, 2018

(30) Foreign Application Priority Data

Oct. 28, 2016 (LU) ..... 93282

(51) Int. Cl.

| | |
|---|---|
| ***H01H 33/04*** | (2006.01) |
| ***H01H 33/02*** | (2006.01) |
| ***H01H 33/53*** | (2006.01) |
| ***H01H 11/00*** | (2006.01) |

(52) U.S. Cl.

CPC ..... *H01H 33/04* (2013.01); *H01H 11/00* (2013.01); *H01H 33/021* (2013.01); *H01H 33/53* (2013.01)

(58) Field of Classification Search

CPC ..... H01H 33/04; H01H 33/021; H01H 33/53; H01H 11/00; H01H 2033/6623; H01B 17/34; H01B 17/36

USPC ..... 218/155, 150, 139, 134

See application file for complete search history.

(56) References Cited

U.S. PATENT DOCUMENTS

| | | | | |
|---|---|---|---|---|
| 1,549,551 A | | 8/1925 | Huber | |
| 1,999,818 A | * | 4/1935 | McIntyre | B21C 37/101 138/165 |
| 4,045,604 A | * | 8/1977 | Clabburn | B29C 63/42 156/86 |

(Continued)

FOREIGN PATENT DOCUMENTS

| | | |
|---|---|---|
| CN | 205542211 U | 8/2016 |
| DE | 19543317 A1 | 5/1997 |

(Continued)

*Primary Examiner* — Edwin A. Leon
*Assistant Examiner* — William A Bolton
(74) *Attorney, Agent, or Firm* — J. Bruce Schelkopf; Taft Stettinius & Hollister LLP

(57) ABSTRACT

It is proposed a liner arrangement for fitting a tubular insulator body in a circuit breaker. The liner arrangement includes a planar, electric-arc resistant and heat resistant liner layer comprising a first edge portion and a second edge portion that is located opposite the first edge portion, wherein the first edge portion has a first contour extending in a direction transversally to a plane defined by the planar liner layer. The second edge portion has a second contour having a geometry that is complementary to the first contour such that the first edge portion can be attached by way of a form fit to the second edge portion once the planar liner layer is bent to a tubular shape. Further, a circuit breaker including a liner arrangement and an insulator is described. A method for protecting an insulator body of a heat chamber insulator for a circuit breaker is also described.

18 Claims, 3 Drawing Sheets

(56) References Cited

U.S. PATENT DOCUMENTS

| | | | | | |
|---|---|---|---|---|---|
| 4,319,076 | A * | 3/1982 | Piur | H01B 17/32 | 174/178 |
| 4,490,422 | A * | 12/1984 | Pascher | B29C 61/10 | 138/156 |
| 4,818,319 | A * | 4/1989 | Beer | H01B 17/32 | 156/192 |
| 5,011,717 | A * | 4/1991 | Moriya | H01B 17/14 | 428/34.4 |

FOREIGN PATENT DOCUMENTS

| | | | | |
|---|---|---|---|---|
| JP | 04050592 | A | 2/1992 | |
| WO | WO2009109216 | A1 * | 9/2009 | H01B 17/00 |

* cited by examiner

LINER ARRANGEMENT AND A CIRCUIT BREAKER WITH A LINER ARRANGEMENT AND METHOD FOR PROTECTING AN INSULATOR BODY

TECHNICAL FIELD

The present disclosure relates to the field of a liner arrangement for an insulator body in a circuit breaker, an insulator body for a heating chamber of a circuit breaker, and a circuit breaker with a heating chamber insulator. The present disclosure refers in particular to a liner arrangement for an insulator body in a generator circuit breaker, an insulator body for a heating chamber of a generator circuit breaker, and a generator circuit breaker with a heating chamber insulator. The present disclosure further relates to a method for protecting an insulator body of a heat chamber insulator for a circuit breaker from heat by a liner arrangement.

BACKGROUND ART

Generally, a circuit breaker is an automatically operated electrical switch designed to protect an electrical circuit from damage caused by overcurrent, overload or short circuits. The basic function of a circuit breaker is to interrupt current flow after protective devices (such as relays) detect a fault. Unlike a fuse, which operates once and then must be replaced, a circuit breaker can be reset to resume normal operation. Circuit breakers are made in varying sizes, from small devices that protect an individual household appliance up to large switchgears designed to protect high voltage circuits feeding an entire city.

Circuit breakers may be applied in various applications. For instance, circuit breakers are used in power stations for ensuring a reliable operation and a smooth delivery of current throughout the entire life of the power station. But also medium-voltage products play a pivotal role in the distribution part and embedded generation of the power value chain, facilitating the "last mile" connect that brings electricity to the users. Circuit breakers serve customers with a reliable, efficient, safe and sustainable technology that allows a much higher value package solution for specific customer needs.

CN205542211U relates to an insulator and a method of manufacturing the insulator having a silicon rubber-based weatherproof jacket fixed on outer surface of a wound pipe. On an inner side of the tubular wound pipe there is an inner liner attached. In an embodiment, the inner liner that is made of a plurality of adjacent tape elements such as fluoropolymer tapes.

U.S. Pat. No. 1,549,551A relates to a device for fastening the overlapping edges of flexible sheet insulating-material adapted to be bent into tubular form for the linings of switch tanks. It comprises a strip of insulating- material provided parallel to its edges with a number of staggered lugs arranged in a row that engage the edges of the sheet.

Circuit breakers provide a heating chamber for supporting the extinction of an electrical arc in the circuit breaker. For instance, the heating chamber may be a part of the arcing chamber of the circuit breaker. In the heating chamber, a gas may be heated by the electrical arc. The gas extinguishes the electrical arc, thereby avoiding damage to the electrical system of which the circuit breaker is part of. However, in the case of electrical arcs having a high intensity, the temperature in the heating chamber may rise to high degrees, such as up to 2000K (for a short time period). The pressure rise may be up to 5 bar/ms. Therefore, the heating chamber is protected by a heating chamber insulator. For instance, the heating chamber insulator may additionally include a PTFE layer for protecting the heating chamber.

The PTFE layer of the insulator body beneficially fulfills good insulating properties and withstands high mechanical stresses. The manufacturing of a PTFE layer with these demands is challenging. In known system, the PTFE layer can for instance be damaged at joining welds due to the high stress. Also, increasing the stability of the PTFE layer comes with additional costs.

In view of the above, a liner arrangement for an insulator body in a circuit breaker, a heating chamber insulator for a circuit breaker, and a method for protecting an insulator body of a heat chamber insulator for a circuit breaker are provided that overcome at least some of the problems in the art.

BRIEF SUMMARY OF THE INVENTION

In view of the above, a liner arrangement for an insulator body in a circuit breaker according to claim 1, a circuit breaker according to claim 9, and a method for protecting an insulator body of heat chamber insulator for a circuit breaker according to claim 14 are provided. The term "liner arrangement" is understood hereinafter as a mechanical piece suitable for linking the tubular insulator body to the rest of the circuit breaker. Further aspects, advantages, and features of the present invention are apparent from the dependent claims, the description, and the accompanying drawings.

According to an aspect of the invention, a liner arrangement for fitting a tubular insulator body in a circuit breaker is provided. The liner arrangement includes a planar, electric-arc resistant and heat resistant liner layer comprising a first edge portion and a second edge portion that is located opposite the first edge portion. The first edge portion and the second edge portion extend in a longitudinal direction of the planar liner layer. The first edge portion has a first contour specifically, i.e. where required extending in a direction transversally to a plane defined by the planar liner layer. The second edge portion has a second contour has a geometry that is complementary to the first contour such that the first edge portion can be attached by way of a form fit to the second edge portion once the planar liner layer is bent to a tubular overall shape.

According to a further aspect of the invention, a circuit breaker is provided including a heating chamber insulator including a tubular insulator body. The circuit breaker further includes a liner arrangement according to embodiments described herein, wherein the liner arrangement is attached to the insulator body.

Typically, the liner arrangement for a heating chamber in a circuit breaker is subjected to high temperature and pressure rises within a short time period. The liner arrangement according to embodiments described herein allows the liner arrangement to protect the heating chamber from the effects of the fast and high temperature and pressure rises. Further, the liner arrangement according to embodiments described herein is more resistant against the mechanical and thermal circumstances in the heating chamber. For instance, the structure of the liner arrangement according to embodiments described herein is less prone to be damaged by cracking welds or blow backs than known insulator systems of heating chambers. According to some embodiments, the liner arrangement as described herein extends the creeping feature (due to better tracking strength) in the insulator body and, therefore, provides a high dielectric strength.

Generally, the liner arrangement according to embodiments described herein offers a solution for more reliability for a circuit breaker, while keeping the manufacturing costs low. For instance, by using a form fit for forming a planar liner material to a tubular shape, the number of process steps is low, which influences the manufacturing costs in a beneficial way. Thereby, also the purchase of the liner material is simplified and less expensive than known solutions. Additionally, the liner arrangement according to embodiments described herein can be produced with only one side of the liner being processed (such as etched) for providing adhesive properties (e.g. for providing adhesive properties to the insulator body). The one-sided processing simplifies the handling of the liner material and the manufacturing of the heating chamber.

According to a further aspect of the invention, a method for protecting a tubular insulator body of a heat chamber insulator for a circuit breaker from heat by a liner arrangement is provided. The method includes connecting a first edge portion of a liner layer having a first contour and a second edge portion of the liner layer having a second contour by form fitting the first edge portion and the second edge portion together to form a substantially tubular and cylindrical liner arrangement. The liner layer includes a material capable of protecting the insulator body from the heat generatable by an electric arc in the cavity of the tubular insulator body. The method further includes providing an insulator body for a circuit breaker around the tubular liner arrangement.

Embodiments described herein allow for providing a dielectric resilient liner arrangement for a heating chamber of a circuit breaker. At the same time, the manufacturing costs are kept low and the reliability of the circuit breaker is increased. Known systems use more production steps and deliver a poorer quality than the liner arrangement according to embodiments described herein.

BRIEF DESCRIPTION OF THE DRAWINGS

The subject matter of the invention will be explained in more detail in the following text with reference to preferred exemplary embodiments which are illustrated in the drawings, in which.

The reference symbols used in the drawings, and their meanings, are listed in summary form in the list of reference symbols. In principle, identical parts are provided with the same reference symbols in the figures.

PREFERRED EMBODIMENTS OF THE INVENTION

According to embodiments described herein, a liner arrangement, and an insulator are provided, which in particular can be used in a circuit breaker, such as (but not limited to) a generator circuit breaker.

Figure 1:
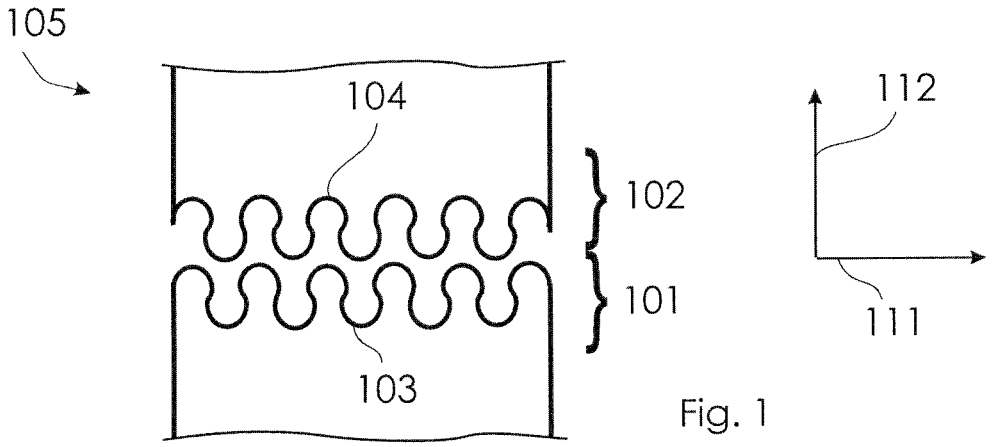
FIG. 1 is a schematic drawing of a liner arrangement in a top view for an insulator body according to embodiments described herein.

FIG. 1 shows an example of a liner layer 105 of a liner arrangement according to embodiments described herein. The liner layer includes a first edge portion 101 and a second edge portion 102. According to some embodiments, the first edge portion 101 and the second edge portion 102 may be edge portions of one sheet of liner material forming the liner layer. The first edge portion 101 includes a first contour 103 and the second edge portion 102 includes a second contour 104. According to embodiments described herein, the geometry of the second contour is complementary to the geometry of the first contour. The first edge portion 101 and the second edge portion 102 extend in a longitudinal direction 111 of the planar liner layer 105.

According to some embodiments described herein, the two contours being complementary to each other may be understood in that the first contour of the first edge portion and the second contour of the second edge portion are complements to each other. For instance, the patterns of the first contour and the second contour pair with each other. In some embodiments, the second contour of the second edge portion is designed or adapted to fill out or complete the first contour, especially to form a substantially closed surface.

The first contour 103 of the first edge portion 101 and the second contour 104 of the second edge portion 102 exemplarily shown in FIG. 1 each provide a pattern , respectively, such as a structural pattern. According to some embodiments, the patterns of the first contour 103 and the second contour 104 are formed so as to match or mate with each other. The patterns provided by the first edge portion and the second edge portion may be described as providing a form fit.

According to embodiments described herein, a form fit as referred to herein may be understood as the fit of two parts (or two edge portions of one part, as described in some embodiments herein) by the shape of the two parts (or edge portions). In particular, the shape of the two parts (or two edge portions) is adapted for mating and/or engaging with each other. The shape of the two parts (or edge portions) is designed dependent on the shape of the other part (or edge portion), respectively. According to some embodiments, the shape of the two parts (or two edge portions) form fitting with each other is chosen so as not to separate, even in case of lacking or interrupted load transmission. In other words, in some embodiments one part (edge portion) hinders the other part (edge portion) from moving out of the fit in the case of a form fitting. According to some embodiments, the form fit hinders the movement out of the fit due to the geometrical shape of the parts (or edge portions), e.g. compared to a force fit or an adhesive bond.

As can be seen in FIG. 1, the first edge 101 and the second edge 102 of the liner layer 105 show engaging structural patterns for providing the form fit. According to some embodiments, the structural pattern may have a drop-like shape (or a meander-like shape). In some embodiments, the structural pattern of the first edge and the second edge of the liner layer may include an undercut. The shape of the structural pattern may also be like a mushroom-head, a hook-and-loop-like shape, a dovetail-like shape or a similar design. According to some embodiments, the first contour and the second contour may be chosen as mating geometries capable of transferring traction force over the interface (or the abutting edges) of the mating first contour and second contour. In some embodiments, the structural pattern may include a step or an inclined surface, as will be explained in detail below.

In some embodiments, the connection of the first contour and the second contour may be permanent. For instance, the connection of the first contour and the second contour may not be solvable without destroying the tubular liner arrangement. According to some embodiments, the connection of the first contour and the second contour may be made without any additives (like glues or the like) or may be reinforced by using a glue or an adhesive. For instance, glues may be used including 1K and/or 2K adhesives. In particular, a glue or adhesive may be chosen, which is suitable and able to withstand the occurring temperatures.

According to some embodiments, the shape of a drop or droplet of the first contour and/or the second contour as exemplarily shown in FIG. 1 has several beneficial effects. For instance, the shape of a drop (having e.g. a continuously formed round shape) is easy to produce and reduces the production costs. Further, the shape of a drop reduces or even prevents the notch effect in the liner layer or in the tubular liner arrangement. According to some embodiments, the radii in the drop-like shape as exemplarily shown in FIG. 1 may be chosen as large as possible, especially for reducing or preventing the notch effect. For instance, the length and the width may correspondingly be chosen, e.g. with the dimensions described in detail below. According to some embodiments, the drop-like shape is also beneficial in view of an optimized contour length, such as a minimized contour length for avoiding unnecessary length of the interface between the first contour and the second contour.

The liner layer 105 including the first edge portion and the second edge portion may be a planar liner layer. In particular, the liner layer 105 may be provided as a sheet of liner material. The planar liner layer 105 may be suitable and adapted for being formed into a tubular (or cylindrical) shape, e.g. by bending and/or merging the first contour and the second contour. Typically, the second edge portion of the liner layer may be located opposite the first edge portion of the liner layer. In other words, the first edge portion and the second edge portion are located at opposite sides of the planar liner layer. Especially, the first edge portion and the second edge portion are located opposite to each other in a length or width direction of the liner layer. In FIG. 1, the first edge portion 101 is shown opposed to the second edge portion 102. The first edge portion 101 and the second edge portion 102 extend in a longitudinal direction 111 of the planar liner layer 105.

In some embodiments, the first edge portion and the first edge portion may extend opposite to each other, but do not have to be parallel to each other. In one example, the first edge portion and the second edge portion being not parallel to each other may yield a conical shape or the shape of a truncated cone when the planar liner layer is bent into a tubular shape.

According to embodiments, the first contour of the first edge portion extends in a direction transversally to a plane defined by the planar liner layer. For instance, the plane defined by the planar liner layer may be spanned by the length/longitudinal and the width direction of the planar liner layer. In FIG. 1, the longitudinal direction is denoted with the reference sign 111 and the width direction is denoted with the reference sign 112. The longitudinal direction is the direction of a longitudinal axis of the liner arrangement defined by its tubular overall shape. According to some embodiments, the contours of the planar liner layer may be described as running along the longitudinal direction 111 of the edge portions of the liner layer. According to some embodiments, the first contour of the first edge portion and the second contour of the second edge portion may extend in a right angle to the width or longitudinal direction of the liner layer. In some embodiments, the first contour and the second contour may extend in an inclined angle (e.g. an angle being different from the right angle) to the length/longitudinal or width direction of the liner layer (as long as the first contour and the second contour are still complementary).

According to some embodiments, which may be combined with other embodiments described herein, the complementary or mating first and second contour form a substantially closed thermal insulation layer, such as an insulation layer protecting the heating chamber from the effects of an electric arc.

Figure 5A:
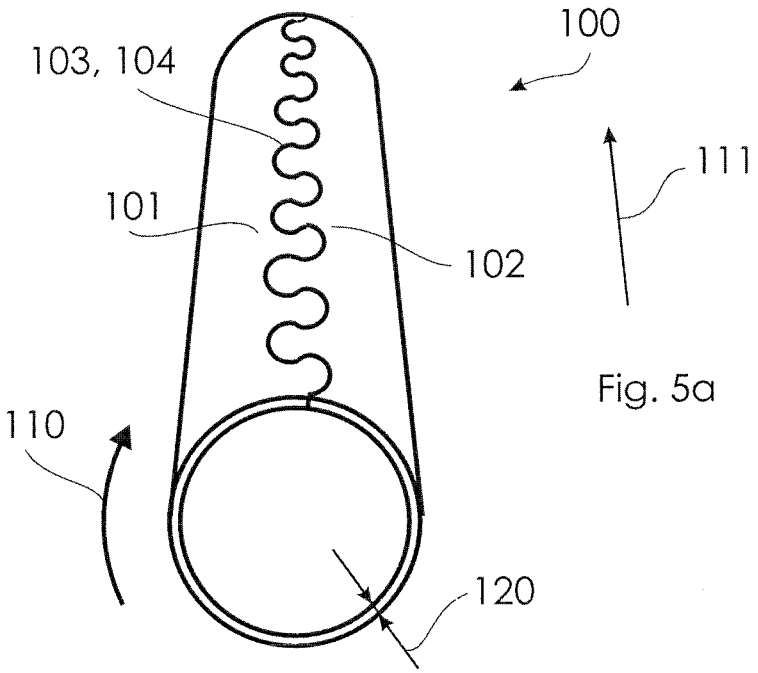
FIG. 5*a* shows a schematic drawing of a liner arrangement in a perspective view having a substantially cylindrical shape in a closed state according to embodiments described herein.

According to some embodiments, which may be combined with other embodiments described herein, the structural pattern as referred to herein may include several (repeating) pattern portions forming the structural pattern. Each pattern portion may include a section with a smaller diameter (or width) and a section with a larger diameter (or width). The diameter of the smaller section and the larger section of one pattern portion may be measured in a direction running along the width of the liner layer or a longitudinal direction of the substantially cylindrical liner arrangement as shown in FIGS. 1 and 5*a*, or may, in some embodiments also be measured along the circumferential direction (as for instance shown in FIG. 7). In some embodiments, the relation of the diameter of the smaller section and the diameter of the larger section of the pattern portions may typically be between about 0.5 and about 0.95, more typically between 0.6 and 0.95, and even more typically between about 0.7 and 0.95. According to some embodiments, the section having the smaller diameter may be located nearer to the rest of the liner layer (the rest without the edge portion) than the section having the larger diameter. In one example, the first edge portion and the second edge portion may have the same structural pattern shape, but in a mating configuration, e.g. in a complement configuration. For instance, a smaller diameter section of the first edge portion may mate between two larger diameter sections of the second edge portion (and vice versa).

Generally, an edge portion of a liner layer may include an edge portion of the liner layer encompassing a defined area of the liner layer. For instance, an edge portion may include up to 20% of the area of the liner layer.

The example of a structural pattern shown in FIG. 1 show a drop-like shape (or a meander-like shape) of engaging patterns of the first edge portion 101 and the second edge portion 102. The number of the heads (or pattern portions)

in the drop-like shape may be understood as an example. The number of the pattern portions is six in the example of FIG. 1. The number of pattern portions of the structural pattern of the liner arrangement according to embodiments described herein may be less than six, such as four, three, or two, or more than the shown number, such as seven, ten, or even more than ten.

In the examples of the figures, the structural patterns are distributed in a substantially regular manner over the length (in the longitudinal direction 111) of the first edge portion and the second edge portion. According to some embodiments, the structural pattern (such as the drop-like pattern, the angular pattern, or any other contour shape) may be distributed in an irregular manner over the length of the first edge portion and the second edge portion. For instance, the distribution of the pattern may be narrower in a first area and broader in a second area (e.g. depending on the load in the respective area). Additionally, or alternatively, the shape and the size of the pattern may vary over the length of the edge portions. For instance, the size of the heads or and/or shafts of the drop-like pattern may vary, e.g. depending on the expected load in a defined area.

According to some embodiments, the geometry of the structural patterns may be chosen according to stability criteria, manufacturing criteria, stiffness criteria, load criteria, material criteria, bending effects with load influence, and the like. For instance, the heads of the drop-like pattern shown in FIG. 1 may be chosen larger or smaller as shown, depending on the intended application, the liner material, the forces appearing between the edges, the bending of the pattern portions under load influence and the like. In some embodiments, the heads of the drop-like shape of the example of FIG. 1 (i.e. the larger diameter section of the pattern portion) may typically have a radius between about 2 mm and about 15 mm, more typically between about 3 mm and about 10 mm, and even more typically between about 5 mm and about 10 mm. The shaft of the drop-like shape (i.e. the smaller diameter section of the pattern portion) may have a length of typically between about 2 mm and about 15 mm, more typically between about 3 mm and about 10 mm, and even more typically between about 5 mm and about 10 mm. The diameter (or width) of the shaft of the drop-like shape may typically be between about 4 mm and about 25 mm, more typically between about 10 mm and about 25 mm, and even more typically between about 10 mm and about 20 mm.

Figure 2:
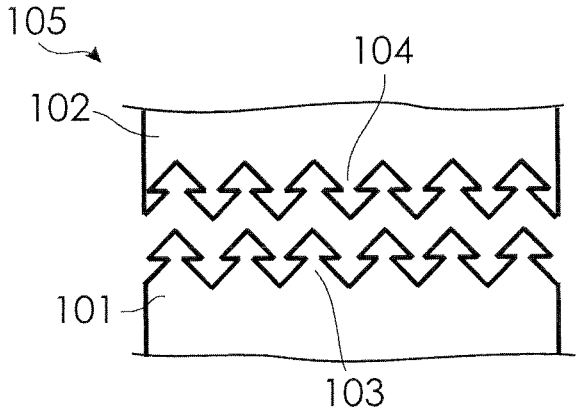
FIG. 2 is a schematic drawing of a liner arrangement in a top view for an insulator body according to embodiments described herein.

FIG. 2 shows an embodiment of a liner layer 105 of a liner arrangement having a first edge portion 101 and a second edge portion 102 being provided with engaging structural patterns. Compared to the structural pattern of FIG. 1, the structural pattern in FIG. 2 includes undercuts in an angular shape, in particular in a substantially triangular shape. Also with respect to FIG. 2, the number of the heads of the structural patterns, and the details of the geometry may be chosen according to the intended application, the liner material, the material thickness, and the like.

Figure 3:
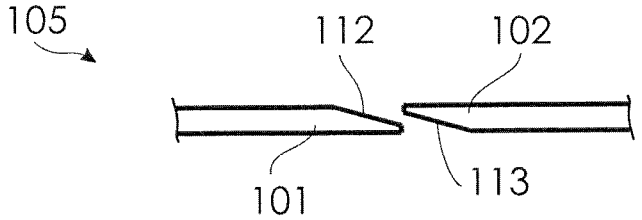
FIGS. 3 and 4 are schematic side views of embodiments of liner arrangements for an insulator body according to embodiments described herein.
Figure 4:
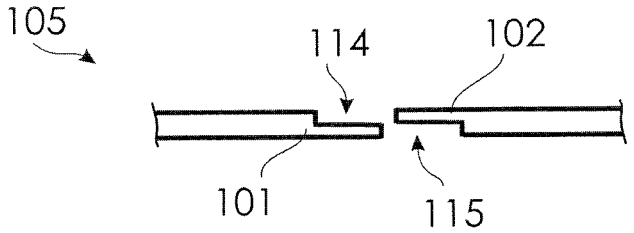

In FIG. 3, a liner layer 105 according to embodiments is shown. The liner layer 105 includes two edge portions, namely the first edge portion 101 and the second edge portion 102. The first edge portion has a first inclined surface 112 and the second edge portion 102 has a second inclined surface 113 mating with the first inclined surface 112. Typically, the inclined surfaces 112, 113 are inclined with respect to the surface of the rest of the liner layer (the rest without the edge portions). In FIG. 4, a step-like structure is provided by the first edge portion 101 and the second edge portion 102. The steps 114 and 115 mate with each other.

According to some embodiments, which may be combined with other embodiments described herein, the inclined surfaces or steps may include further details on the mating surfaces of the inclined surfaces or steps for improving the fit between the first edge portion and the second edge portion. For instance, the respective mating surfaces may include hooks and loops (e.g. like a hook-and-loop fastener) for providing a reliable form fit of the first edge portion and the second edge portion. In another example, the respective mating surfaces may include a suitable surface configuration for improving the form fit. For instance, the respective mating surfaces may have a defined roughness or structure (e.g. having mountain and valleys) providing or improving the form fit. In the embodiments shown in FIGS. 3 and 4, the first contour and the second contour may be understood as a contour within the plane of the liner layer.

FIG. 5*a* shows a substantially tubular (e.g. cylinder-like) liner arrangement 100 according to embodiments described herein. In the example shown in FIG. 5*a*, the liner layer includes a single liner layer sheet having the first edge portion 101 and the second edge portion 102. As can be seen in the example of FIG. 5*a*, the structural patterns of the first edge portion 101 and the second edge portion 102 (extending along the longitudinal direction 111 of the liner layer and the tubular liner arrangement) engage with each other in circumferential direction 110 of the liner arrangement 100. In other words, the first edge portion 101 and the second edge portion 102 close the tubular shape of the liner arrangement. According to some embodiments, the first edge portion 101 and the second edge portion 102 can be described as closing the shell surface of the cylinder-like shape of the liner arrangement in circumferential direction 110 of the cylinder-like shape. The direction of engagement of the first edge portion 101 and the second edge portion 102 is the circumferential direction 110.

A tubular element as described herein may be understood as a hollow object extending in a longitudinal direction (such as the longitudinal direction 111 in FIG. 5*a*). According to some embodiments, the tubular element may also be described as a pipe, having in particular openings at both ends. According to some embodiments, the tubular liner arrangement may be formed from the substantially planar liner layer by attaching two edge portions of the planar liner arrangement to each other, e.g. by a form fit as described above. The tubular shape may provide any suitable outer shape (or any suitable cross-sectional shape intersected at a position in the longitudinal direction 111), such as a round shape, an angular shape, a polygonal shape, a circular shape, an oval shape and the like. In some embodiments, the tubular liner arrangement may have a substantially cylindrical shape or a cylinder-like shape.

A cylinder-like shape as described herein may be understood as a geometrical body having two cut areas and a shell surface. In particular, the two cut areas have substantially the same shape. In one embodiment, the cylinder-like arrangement of the shape arrangement may be have substantially circular cut areas, forming a circular cylinder. In other embodiments, other shapes of the cut areas may be considered, such as an oval shape, an angular shape, a polygonal shape or the like. Although the embodiments of the figures show a circular cylinder, embodiments are not limited to circular cylinders. According to embodiments described herein, a substantially cylindrical shape as used herein and as provided by the liner arrangement according to embodiments described herein, may be an open cylinder including the shell surface, and no material cut areas at the ends of the shell surface.

The term "substantially" as used herein may mean that there may be a certain deviation from the characteristic denoted with "substantially." For instance, the term "substantially circular" refers to a shape which may have certain deviations from the exact circular shape, such as a deviation of about 1% to 10% of the general extension in one direction. According to a further example, the term "substantially cylindrical" may refer to an arrangement, which may include deviations from the exact cylindrical shape, such as deviations regarding the symmetry, the similarity of the two cur areas, the dimensions of the cut areas and/or the shell surface and the like. According to some embodiments, the deviations may include deviations up to 10% of the respective dimension.

Figure 5B:
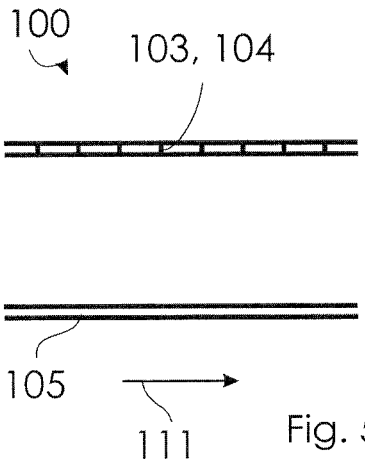
FIG. 5*b* shows a schematic drawing of a sectional view of the liner arrangement of FIG. 5*a* in longitudinal direction.

FIG. 5*b* shows a schematic sectional view of the liner arrangement 100 shown in FIG. 5*a*. The sectional view runs along the longitudinal direction 111, as can be seen by the in FIG. 5*a*. The liner arrangement 100 of FIG. 5*a* has a tubular, substantially cylindrical shape. In FIG. 5*a*, the interface between the structural patterns 103, 104 (i.e. the abutting edges of the contours) is shown in a regular distance referring to the regular distribution of the drop-like shape along the contour of the edge portions of the liner layer (as for instance shown in FIG. 1).

Figure 6:
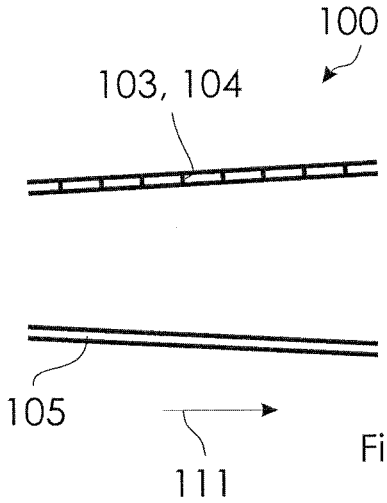
FIG. 6 shows a schematic drawing of a sectional view of a liner arrangement according to embodiments described herein in longitudinal direction.

FIG. 6 shows another example of a liner arrangement 100 according to embodiments described herein. In FIG. 6, a schematic sectional view of a liner arrangement 100 in longitudinal direction 111 similar to FIG. 5*b* is shown. In the schematic sectional view of the tubular liner arrangement 100 of FIG. 6, the interface (or the abutting edges) of the structural patterns 103, 104 can be seen. The tubular liner arrangement has a conical shape, e.g. a slightly conical or tapered shape along the longitudinal direction 111 of the liner arrangement 100. According to some embodiments, the conical shape of the tubular liner arrangement may provide an inclination of several degrees along the length of the liner arrangement, such as typically between about 0.1° to about 5°, more typically between about 0.1° and about 3°, and even more typically between about 0.1° and about 2°. For instance, the inclination of the conical shape may be suitable for removing the liner arrangement (once bent into the tubular shape) from a mandrel. According to some embodiments, the inclination of the conical shape may be suitable for removing the liner arrangement from a mandrel after the liner arrangement has been formed around the mandrel and, eventually further process steps have been performed on the liner arrangement (such as forming an insulator material around the liner arrangement on the mandrel, as described in detail below with respect to the method according to embodiments described herein).

Figure 7:
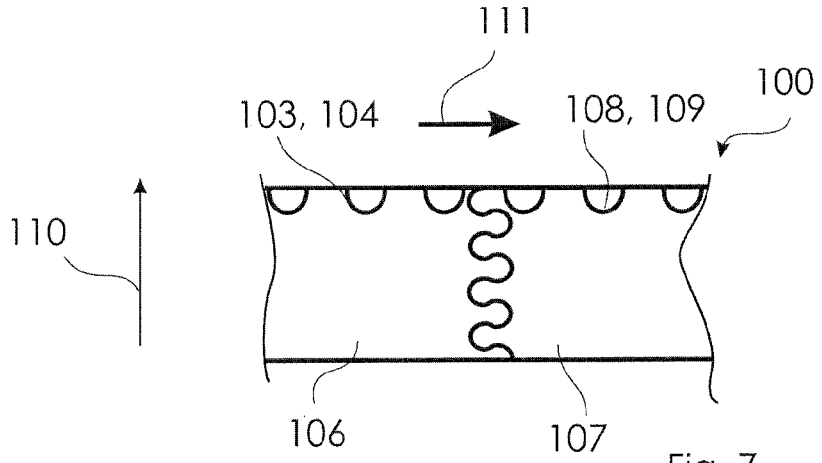
FIG. 7 shows a schematic partial side view of a liner arrangement for an insulator body in a closed state according to embodiments described herein.

FIG. 7 shows a further embodiment of a liner arrangement in a side view. The liner arrangement 100 shown in FIG. 7 shows a first tubular liner layer 106 and a second tubular liner layer 107. The first tubular liner layer 106 may be formed into the tubular shape by a form fit of a first contour 103 of a first edge portion and a second contour 104 of a second edge portion. The second tubular liner layer 107 may be formed into the tubular shape by a form fit of a first contour 108 of a first edge portion and a second contour 109 of a second edge portion. According to some embodiments, the liner layers 106 and 107 may be liner layers as described above, such as a liner layer as described with respect to FIGS. 1 to 6. For instance, the first liner layer 106 and the second liner layer 107 may each have a structural pattern, respectively, as explained above. The structural pattern provided by each of the first tubular liner arrangement 106 and the second tubular liner arrangement 107 is shown as a drop-like shape in the example of FIG. 7 (only shown in parts due to the side view in FIG. 7), but is not limited to the drop-like shape. As can be seen in the example of FIG. 7, the structural patterns 103, 104 of the first liner layer 106 as well as the structural patterns 108, 109 of the second liner layer extend along the longitudinal direction 111 of the liner arrangement and engage with each other in circumferential direction 110 of the liner arrangement 100.

According to some embodiments described herein, the first liner layer 106 and the second liner layer 107 are bent into a tubular shape so as to form a first tubular liner arrangement and a second tubular liner arrangement. In the example shown in FIG. 7, the first tubular liner arrangement and the second tubular liner arrangement are attached to each other by a form fit. In particular, the first tubular liner arrangement and the second tubular liner arrangement are put together along the longitudinal direction 111 of the liner arrangement 100. For instance, the first tubular liner arrangement and the second tubular liner arrangement may be provided in the shape of two cylinder-like liner layer sheets, each having a structural pattern at an edge portion for providing the form fitting between the two tubular liner arrangements. According to some embodiments, a liner layer being provided for a form fit in circumferential direction 110 and in the longitudinal direction 111 as shown in FIG. 7 may have a contour or structural pattern on adjacent edge portions of the liner layer.

In any case, the liner arrangement may include more than one first edge portion having a first contour and more than one second edge portion having a second contour, being e.g. pairwise connected by a form fitting. For instance, the liner arrangement may include more than one first edge portion and more than one second edge portion being connected in circumferential direction or longitudinal direction of the liner arrangement. In some embodiments, only one of the first edge portions and one of the second edge portions may be connected by a form fitting, while other edge portions may be connected in another way (e.g. by adhesives, welding, melting, etching or the like).

According to some embodiments, which may be combined with other embodiments described herein, the liner arrangement may have a wall thickness of typically between about 1 mm and about 10 mm, more typically between about 2 mm and about 8 mm, and even more typically between about 2 mm to about 5 mm. The wall thickness of the liner arrangements (in particular measured in radial direction of the tubular liner arrangement) is exemplarily shown in FIG. 5*a* as wall thickness 120. In some embodiments, the liner arrangement according to embodiments described herein may have an outer circumference typically between about 200 mm and about 2000 mm, more typically between about 300 mm and about 1800 mm, and even more typically between about 300 mm and about 1600 mm. The inner diameter of the tubular liner arrangement may typically be between about 50 mm and about 800 mm, more typically between about 100 mm and about 600 mm, and even more typically between about 100 mm and about 550 mm. According to some embodiments, the inner diameter of the tubular liner arrangement may be between about 280 mm and about 380 mm.

According to some embodiments, which may be combined with other embodiments described herein, the structural pattern of the first edge portion and the second edge portion is adapted and designed to have an oversize when mating. The first edge portion and the second edge portion, when being mated, may have substantially no gap between them or a gap of 0 mm or less between them (for instance between the pattern portions of the structural pattern) or may even have a press fit between them. In particular, the gap between the first edge portion and the second edge portion being 0 mm or the press fit between the first edge portion and the second edge portion may provide a substantially closed insulation layer and/or may prevent the damaging of the liner arrangement during appearance of an electrical arc, and may protect the heat chamber insulator. A gap between the first edge portion and the second edge portion may offer a starting point for the liner arrangement failure. By avoiding a gap between the first edge portion and the second edge portion, and in particular the structural pattern of the first edge portion and the second edge portion, no notch effect is generated in the liner arrangement. Compared thereto, known liners being welded often suffer from the notch effect and the resulting damaging and destruction of the liner arrangement. For instance, known liners are welded using an additional welding material (e.g. PFA-perfluouralkoxy polymers). The additional welding material often has poorer mechanical and thermic properties than the liner material (being e.g. PTFE).

In some embodiments, which may be combined with other embodiments described herein, the liner arrangement may include an adhesive surface for being glued to an insulator body. For instance, the liner arrangement according to embodiments described herein may have an adhesive surface for being attached to an insulator body of a circuit breaker. The adhesive surface of the liner arrangement may be adapted and/or chosen dependent on the material, the surface structure, the intended application, and the like, of the insulator body. In some embodiments, the outer surface of the substantially cylindrical liner arrangement may be treated for providing adhesive properties. For instance, the outer surface of the liner arrangement may be seen in FIG. 5*a* as the outer surface of the substantially cylindrical liner arrangement 100. In some embodiments, which may be combined with other embodiments described herein, the treatment of the outer surface of the liner arrangement (and in particular only the outer surface) for providing adhesive properties may include etching the outer surface.

According to some embodiments, which may be combined with other embodiments described herein, the material of the liner arrangement (or of a liner layer or a liner layer sheet) may be capable of protecting the insulator body (e.g. of an insulator body for a circuit breaker) from the heat of an electric arc in the insulator body. As explained above, in an insulator body of a circuit breaker, an electrical arc may appear and may be extinguished for not damaging the circuit breaker. The electrical arc in the insulator body may reach temperatures up to 4000° C. or more. For instance, the liner material may be heat resistant up to 260° C. In some embodiments, the liner material may be a non-conductive (especially electric-arc resistant) and heat resistant material.

According to some embodiments, the term "electrical arc-resistant" material may be understood as a material capable of withstanding high temperature changes and/or high pressure changes. For instance, (short-term) temperature changes of about 2000K) and/or pressure changes of up to 5 bar/ms may occur in a heating chamber insulator according to embodiments described herein.

According to some embodiments, the material of the liner layer may be a high temperature polymer material, such as PES (polysulfone), PEEK (polyetheretherketone), all variants of PTFE (PFA, FEP and the like), and/or mixtures thereof. According to some embodiments, the material of the liner layer may include further components for improving or optimizing beneficial properties of the material of the liner layer. For instance, the material of the liner layer may include a filler material, such as $MoS_2$ oder $Al_2O_3$.

Figure 8:
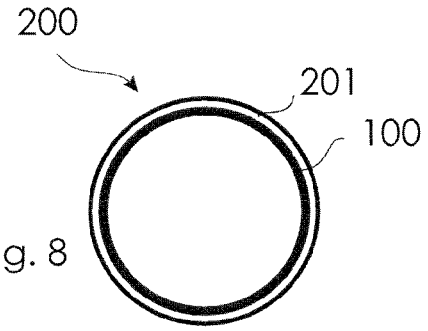
FIG. 8 shows a sectional view of a heating chamber insulator with a liner arrangement according to embodiments described herein.

According to some embodiments, a heating chamber insulator for a circuit breaker, in particular a generator circuit breaker, is provided. FIG. 8 shows an example of a heating chamber insulator 200 according to embodiments described herein. The heating chamber insulator 200 includes an insulator body 201 and a liner arrangement 100 according to embodiments described herein. For instance, the liner arrangement may be attached to an interior wall of the tubular insulator body 201, such as glued to the insulator body 201, in particular by an adhesive surface of the liner arrangement (which may be obtained by etching).

In some embodiments, which may be combined with other embodiments described herein, the insulator body may be formed over the liner arrangement, which will be explained in detail below with respect to the method for protecting an insulator body with a liner arrangement according to embodiments described herein. The insulator body may include an insulator body material, such as a polymeric material, epoxy resin, polyester, cyanidester (e.g. in the form of a fiber reinforced material or without fibers). In some embodiments, the insulator body material may include fiber- (e.g. basalt or glass) or fabric-reinforced (e.g. glass cloth) materials for optimized mechanical properties and the like. According to some embodiments, substantially all non-conductive, electrically insulating fibers may be used in the insulator body. In some embodiments, the fibers may be choses to have a chemical resistance against $SF_6$ byproducts (e.g. $SF_4$, HF etc.) Furthermore, in some embodiments, fiber-free tapes may be used for forming the insulator body, such as a PTFE body. According to some embodiments, the material of the heating chamber insulator may be heat resistant up to 260° C.

According to some embodiments, the liner arrangement may be attached to the insulator body by providing an adhesive surface, such as an etched outer surface of the liner layer, an interconnecting layer (as exemplarily described above), a glue layer, a correspondingly treated inner surface of the insulator body or the like.

Figure 9:
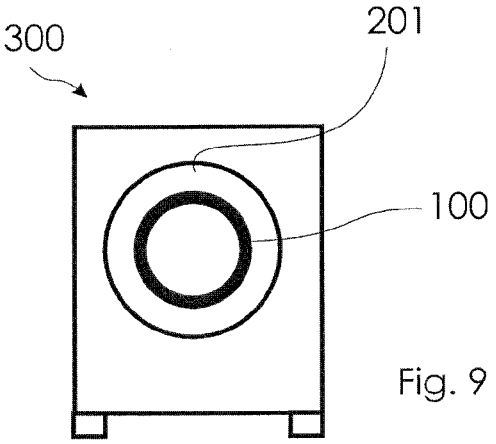
FIG. 9 shows a sectional view of a circuit breaker having a heating chamber insulator and a liner arrangement according to embodiments described herein.

According to some embodiments, a circuit breaker, in particular a generator circuit breaker, is provided. An example of a circuit breaker is shown in FIG. 9. The circuit breaker 300 exemplarily shown in FIG. 9 may include a heating chamber having a tubular insulator body 201 and a liner arrangement 100 according to embodiments described herein. The tubular insulator body may have a substantially cylindrical shape, as described above, a conical shape, or may have any suitable cross-section, such as a substantially round cross-section, or a polygonal cross-section. Generally, the circuit breaker as described herein may have further features of a circuit breaker, such as extinguishing gas or vacuum for extinguishing the electrical arc in the arcing chamber, a supply for the extinguishing gas, cooling apparatuses, control units, switching units for operating the circuit breaker, a housing for the circuit breaker, and the like. In some embodiments, in the case of an electrical arc in the circuit breaker, the extinguishing gas (e.g. a dielectric gas) may be heated by the electrical arc and the pressure rises. The expanding extinguishing gas may extinguish the electrical arc (thereby, the extinguishing effect is the larger the larger the electrical arc is).

In some embodiments, which may be combined with other embodiments described herein, the size of the heating chamber insulator may approximately correspond the size of the liner arrangement. In particular, the inner diameter of the insulator body may correspond to the outer diameter of the liner arrangement (as described in detail above). According to some embodiments, the heating chamber for the circuit breaker (including the heating chamber insulator body and the casing for the extinguishing gas) may have an inner diameter of typically between about 300 mm and about 800 mm, more typically between about 400 mm and about 700 mm, and even more typically between about 400 mm and about 500 mm (e.g. with a liner arrangement diameter of about 300 mm).

In some embodiments, the circuit breaker according to embodiments described herein may be a circuit breaker for applications in the power range of about 80 MW and higher, such as up to 1.5 GW (e.g. a generator), in high current applications having a rated nominal current of about 2000 A to about 40 kA (for example 24 kA), or high voltage applications of about 30 kV to about 50 kV. In the case that the circuit breaker is a generator circuit breaker, the circuit breaker may be adapted for being connected a generator and a voltage transformer. For instance, the circuit breaker may be used at the outlet of high-power generators (e.g. high power generator with about 100 MW to about 1800 MW) in order to protect the generator in a reliable, fast and economic manner. The circuit breaker is adapted to be able to allow the passage of high permanent currents under continuous service, and have a high breaking capacity.

Figure 10:
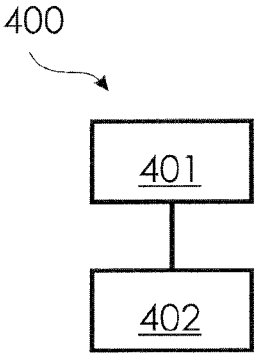
FIG. 10 shows a flow chart of a method for protecting an insulator body of a heat chamber insulator according to embodiments described herein.

FIG. 10 shows a flow chart of a method 400 for protecting a tubular insulator body of a heat chamber insulator for a circuit breaker from heat by a liner arrangement (which may be a liner arrangement according to embodiments described herein). The method 400 includes in block 401 connecting a first edge portion of a liner layer having a first contour and a second edge portion of a liner layer having a second contour being complementary to the first contour by form fitting. The first edge portion and the second edge portion are connected or attached to each other for forming a substantially tubular and cylindrical liner arrangement. For instance, the form fitting may be provided by a structural pattern of the first contour of the first edge portion mating with a structural pattern of the second contour of the second edge portion. According to some embodiments, the form fitting between the first edge portion and the second edge portion may prevent a separation of the first edge portion and the second edge portion after mating, in particular a separation of the first edge portion and the second edge portion during operation of the circuit breaker. In some embodiments, which may be combined with other embodiments, the structural pattern for providing the form fitting may include an engaging structural pattern, a meander-like shape, a mushroom head, a drop-like shape, a dovetail-like shape, a T-slot like shape, an inclined surface, and/or a step the first edge portion.

According to some embodiments, the first contour and the second contour may be chosen as mating geometries capable of transferring traction force over the interface of the mating first contour and second contour. According to some embodiments, the structural pattern may be a structural pattern as exemplarily shown and described with respect to FIGS. 1 to 7.

The connected first edge portion and the second edge portion together form a tubular liner arrangement, as exemplarily shown in FIGS. 5*a* to 7. The first edge portion and the second edge portion may be edge portions of the same liner layer sheet. The liner layer typically includes a material capable of protecting the insulator body from the heat, which may be generated by an electric arc in the cavity of the tubular insulator body, which may, as described above, include a material being heat-resistant up to 260° C. In some embodiments, the liner arrangement may be capable of withstanding short-term temperature rises up to 2000K and/or pressure changes of up to 5 bar/ms. For instance, the liner layer may include, or may even be made of, PTFE.

In block 402, the method 400 according to embodiments described herein includes providing an insulator body for a circuit breaker around the tubular (e.g. substantially cylindrical) liner arrangement. For instance, the liner arrangement may be formed around a mandrel for obtaining the substantially cylindrical shape of the liner arrangement. On the mandrel, the liner layer may be "closed" to the liner arrangement by the form fitting of the first edge portion of the liner layer and the second edge portion of the liner layer. In the case, the liner layer is provided by two liner layers (each one providing at least one first edge portion and at least one second edge portion) the substantially cylindrical shape of the liner arrangement may include more than one joint or seam connecting the first liner layer and the second liner layer to the liner arrangement according to embodiments described herein (as can exemplarily be seen in FIG. 7). In one example, the more than one joint or seam in the case of two liner layers may also include a form fitting, e.g. being similar or the same as described in embodiments herein. According to some embodiments, the method may include shrinking the liner arrangement around the mandrel.

According to some embodiments, the method may include winding an insulator material around the liner arrangement being formed around the mandrel. For instance, the insulator material including one or more materials of the insulator body may be wound around the liner arrangement being still positioned on the mandrel. In some embodiments, the insulator body to be formed around the liner arrangement may include several layers of insulator materials (such as up to 10 layers with a material including e.g. aramid tape). One or some of or all of the insulator materials may be wound around the liner arrangement. In some embodiments, some insulator materials of the insulator body may be poured around the wound insulator material, e.g. for achieving even better insulator properties. In some examples, a layer of insulation material including a tape may be wound around the mandrel, while an epoxy resin or an epoxy resin mixture may be provided to impregnate the wound tape(s). For instance, a RTM (resin transfer moulding) process or a vacuum infusion may be used.

Though the present invention has been described on the basis of some preferred embodiments, those skilled in the art should appreciate that those embodiments should by no way limit the scope of the present invention. Without departing from the spirit and concept of the present invention, any variations and modifications to the embodiments should be within the apprehension of those with ordinary knowledge and skills in the art, and therefore fall in the scope of the present invention which is defined by the accompanied claims.

REFERENCE NUMERALS

100 liner arrangement
101 first edge portion
102 second edge portion
103 structural pattern of first edge portion
104 structural pattern of second edge portion
105 liner layer
110 circumferential direction of liner arrangement
111 longitudinal direction of liner arrangement
112, 113 inclined surfaces of edge portions
114, 115 steps of edge portions

120 thickness of liner arrangement
200 heating chamber insulator
201 insulator body
300 circuit breaker
400 flow chart
401, 402 blocks of flow chart

The invention claimed is:

1. A liner arrangement within a tubular insulator body of a circuit breaker, the liner arrangement comprising:

a planar, electric-arc resistant, heat resistant and non-conductive liner layer comprising a first edge portion and a second edge portion that is located opposite the first edge portion, wherein the first edge portion and the second edge portion extend in a longitudinal direction of the planar liner layer, wherein the first edge portion has a first contour, wherein the second edge portion has a second contour having a geometry that is complementary to the first contour such that the first edge portion can be attached by way of a form fit to the second edge portion once the planar liner layer is bent to a tubular shape, wherein the first contour and the second contour extend along the longitudinal direction of the planar liner layer, and wherein the first contour and the second contour comprise structural patterns that are distributed along the longitudinal direction of planar liner layer.

2. The liner arrangement according to claim 1, wherein the form fit is provided by the first contour of the first edge portion and the second contour of the second edge portion by comprising at least one of: a meander shape, a mushroom head closure, a drop shape, a dovetail shape and a T-slot shape.

3. The liner arrangement according to claim 1, wherein the electric-arc resistant, heat resistant liner and non-conductive liner layer comprises a liner material being heat resistant up to 260° and/or wherein the electric-arc resistant, heat resistant liner and non-conductive liner layer comprises PTFE.

4. The liner arrangement according to claim 3, wherein the form fit is provided by the first contour of the first edge portion and the second contour of the second edge portion by comprising at least one of: a meander shape, a mushroom head closure, a drop shape, a dovetail shape and a T-slot shape.

5. The liner arrangement according to claim 1, wherein the liner arrangement has a wall thickness of about 2 mm to about 5 mm.

6. The liner arrangement according to claim 1, wherein the liner arrangement includes an adhesive surface for being glued to an interior wall of the tubular insulator body of the circuit breaker.

7. The liner arrangement according to claim 6, wherein the liner arrangement is substantially cylindrical and an outer surface thereof is etched for providing adhesive properties.

8. The liner arrangement according to claim 6, wherein the form fit is provided by the first contour of the first edge portion and the second contour of the second edge portion by comprising at least one of: a meander shape, a mushroom head closure, a drop shape, a dovetail shape and a T-slot shape.

9. A circuit breaker comprising:

a heating chamber insulator comprising a tubular insulator body;

a liner arrangement within the tubular insulator body in the circuit breaker, the liner arrangement comprising:

a planar, electric-arc resistant, heat resistant and non-conductive liner layer comprising a first edge portion and a second edge portion that is located opposite the first edge portion, wherein the first edge portion and the second edge portion extend in a longitudinal direction of the planar liner layer, wherein the first edge portion has a first contour, and wherein the second edge portion has a second contour having a geometry that is complementary to the first contour such that the first edge portion can be attached by way of a form fit to the second edge portion once the planar liner is bent to a tubular shape;

wherein the first contour and the second contour extend along the longitudinal direction of the planar liner layer, and wherein the first contour and the second contour comprise structural patterns that are distributed along the longitudinal direction of planar liner layer.

10. The circuit breaker according to claim 9, wherein the circuit breaker is a generator circuit breaker.

11. The circuit breaker according to claim 10, wherein the tubular insulator body of the heating chamber insulator comprises a fiber-reinforced polymeric material.

12. The circuit breaker according to claim 10, wherein the liner arrangement is glued to the tubular insulator body of the heating chamber insulator.

13. The circuit breaker according to claim 10, wherein the heating chamber insulator is designed for withstanding a pressure rise within the tubular insulator body of up to 5 bar/ms.

14. The circuit breaker according to claim 9, wherein the tubular insulator body of the heating chamber insulator comprises a fiber-reinforced polymeric material.

15. The circuit breaker according to claim 9, wherein the liner arrangement is glued to the tubular insulator body of the heating chamber insulator.

16. The circuit breaker according to claim 9, wherein the heating chamber insulator is designed for withstanding a pressure rise within the tubular insulator body of up to 5 bar/ms.

17. A method for protecting a tubular insulator body of a heat chamber insulator for a circuit breaker from heat by a liner arrangement, the method comprising:

connecting a first edge portion of a liner layer having a first contour and a second edge portion of the liner layer having a second contour being complementary to the first contour by form fitting the first edge portion and the second edge portion together to form a substantially tubular cylindrical liner arrangement, wherein the first edge portion and the second edge portion extend in a longitudinal direction of the planar liner layer, wherein the first contour and the second contour extend along the longitudinal direction of the planar liner layer, wherein the first contour and the second contour comprise structural patterns that are distributed along the longitudinal direction of planar liner layer, wherein the liner layer comprises a material being non-conductive and capable of protecting the tubular insulator body from the heat generatable by an electric arc in a cavity of the tubular insulator body; and forming the tubular insulator body for the circuit breaker around the tubular liner arrangement.

18. The method according to claim 17, wherein connecting the first edge of the liner layer and the second edge portion of the liner layer by form fitting comprises providing the first contour of the first edge portion and the second contour of the second edge portion with at least one of: an engaging structural pattern, a meander shape, a mushroom head closure, a drop shape, a dovetail shape and a T-slot shape.

* * * * *